United States Patent [19]

Riordan

[11] 3,987,346

[45] Oct. 19, 1976

[54] PURGE TIMER FOR BURNER CONTROL SYSTEM

[75] Inventor: William J. Riordan, Shrewsbury, Mass.

[73] Assignee: The Walter Kidde & Company, Inc., Clifton, N.J.

[22] Filed: Nov. 29, 1974

[21] Appl. No.: 528,224

[52] U.S. Cl. ..... 317/142 R; 431/29

[51] Int. Cl.[2] ..... H01H 47/18

[58] Field of Search ..... 431/29, 30, 31; 34/45, 34/53; 328/77, 78; 317/141 R, 141 S, 151, 154, 142 R

[56] References Cited

UNITED STATES PATENTS

| | | | |
|---|---|---|---|
| 2,347,714 | 5/1944 | Sorensen | 317/142 R |
| 3,393,037 | 7/1968 | Giuffrida et al. | 431/31 X |

FOREIGN PATENTS OR APPLICATIONS

| | | | |
|---|---|---|---|
| 1,614,322 | 5/1970 | Germany | 317/142 |

*Primary Examiner*—Harry Moose
*Attorney, Agent, or Firm*—John E. Toupal

[57] ABSTRACT

Disclosed herein is a fuel burner control system with a purge timer having a current responsive control relay that is energized into an active state only by a given minimum input current level but can be maintained in that active state by a substantially lesser input current level. After connection to an electrical supply an activating circuit supplies the given input current level to the control relay only after a predetermined purge time period established by an electrical timer, after which a hold circuit supplies the lesser input current level maintaining the relay in its active state. A blower dissipates any residual fuel vapor in the vicinity of the burner during the purge period and only after its conclusion is fuel flow initiated and ignition attempted in response to contact closures effected in the relay's active state. In a preferred embodiment of the invention, the purge timer comprises an energy storage capacitor which is charged from the supply during the purge period after which a threshold device dumps the energy stored in the capacitor to produce the current level required to move the control relay into its active state.

13 Claims, 1 Drawing Figure

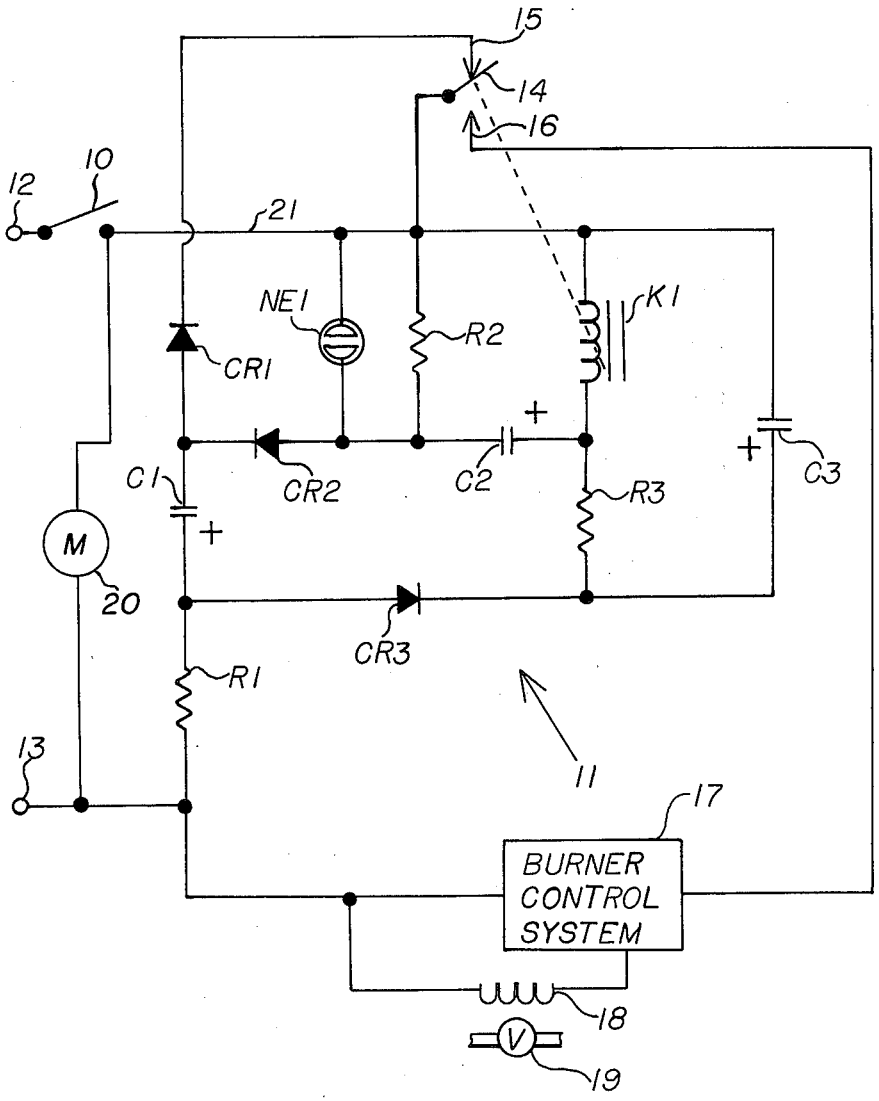
15
14
16
10
12
21
NE1
R2
K1
CR1
+
+
C1
CR2
C2
R3
C3
M
20
CR3
R1
13
11
17
BURNER
CONTROL
SYSTEM
18
V
19

PURGE TIMER FOR BURNER CONTROL SYSTEM

BACKGROUND OF THE INVENTION

In many types of fuel burner applications, it is desirable to provide a purge time prior to initiating the flow of fuel and ignition thereof at the burner. During the purge period a blower is energized to dissipate any fuel vapor that may occupy the region adjacent to the burner because of some inadvertence such as a leaky fuel valve. The dissipation of residual fuel vapor eliminates the possibility of an explosion during an attempt to ignite newly released fuel.

Various types of systems for establishing purge periods have been both proposed and developed. However, none of these prior systems have proven fully satisfactory. For example, those employing mechanical timers are both bulky and expensive while electrical units generally fail to offer the reliability desired for safety equipment of this type. One problem associated with many prior electrical purge timers is a tendency to trigger a try for ignition prior to the expiration of a predetermined purge period. Such a malfunction can be caused, for example, by a failure of individual components in the electrical timing circuits employed or by the inadvertent triggering of electronic switches such as SCR's by extraneously introduced signals. Another disadvantage of many prior purge timers is their failure to reset instantly upon completion of a purge timing period. The failure of a purge timer to reset instantly is particularly troublesome in burner applications employing dual fuels. For example, when switching from an oil to a gas supply, flame at the burner is usually extinguished so that a new gas flame must be ignited. However, the rotational inertia of the fuel oil pumps typically employed in such systems will continue to supply oil for a few seconds resulting in the accumulation of oil vapor in the vicinity of the burner. To insure against detonation of this vapor when a try for gas ignition is made, a full purge period is required but will not be available if the timer was not reset upon completion of the purge timing period preceding the previous ignition attempt at the burner.

The object of this invention, therefore, is to provide an improved burner control system with an electrical purge timer that will reliably produce a predetermined purge period before each ignition attempt regardless of the condition of its individual components or the environment in which it is used.

SUMMARY OF THE INVENTION

The present invention provides a fuel burner control system with a purge timer having a current responsive control relay that is energized into an active state only by a given minimum input current level but can be maintained in that active state by a substantially lesser input current level. After connection to an electrical supply, an activating circuit supplies the given input current level to the control relay only after a predetermined purge time period established by an electrical timer, after which a hold circuit supplies the lesser input current level maintaining the relay in its active state. This allows a blower to dissipate any residual fuel vapor in the vicinity of the burner during the purge period and only after its conclusion is fuel flow initiated and ignition attempted in response to contact closures effected in the relay's active stage. In a preferred embodiment of the invention, the purge timer comprises an energy storage capacitor which is charged from the supply during the purge period after which a threshold device dumps the energy stored in the capacitor to produce the current level required to move the control relay into its active state.

According to one feature of the invention, the activating circuit includes a reset circuit that bleeds any residual energy from the energy storage capacitor and prevents the flow of charging current thereto with the control relay in its active state. This reset function insures that the timer is always in condition to provide a full purge period prior to any try for burner ignition.

DESCRIPTION OF THE DRAWINGS

These and other objects and features of the present invention will become more apparent upon a perusal of the following description taken in conjunction with the accompanying drawing which is a schematic circuit diagram illustrating a preferred embodiment of the invention.

DESCRIPTION OF THE PREFERRED EMBODIMENT

Shown in the FIGURE is a purge timer control circuit 11 that is connected by a switch 10, such as a thermostat, to a pair of terminals 12 and 13 for connection to an AC supply. Included in the circuit 11 are a pair of normally closed contacts 14, 15 and a pair of normally open contacts 14, 16, the latter of which connect a burner control system 17 across the terminals 12 and 13 via the switch 10. The system 17 is a conventional burner control unit including an ignition system for igniting fuel at a fuel burner (not shown). A solenoid 18 is energized by the burner control system 17 and opens a valve 19 which supplies fuel to the burner. Also, connected across the terminals 12 and 13 by the switch 10 is a motor 20 of a conventional blower (not shown) that circulates air through the region occupied by the burner's nozzle (not shown).

A resistor R1, a capacitor, C1, a diode CR1 and the contacts 14, 15 are connected in series between the terminal 13 and a bus 21 connected to the switch 10. Between the junction joining the diode CR1 and the capacitor C1 is a series combination of a diode CR2, a capacitor C2 and a winding of a relay K1 that includes the contacts 14, 15 and 16. A parallel combination of a neon NE1 and a resistor R2 is connected between the bus 21 and the junction between the diode CR2 and the capacitor C2. Spanning between one end of the relay winding K1 and the junction between the capacitor C1 and the resistor R1 are a diode CR3 and a resistor R3 while a filter capacitor C3 is connected across that winding and the resistor R3.

Operation of the system is begun by closure of the switch 10 which typically would entail a request for heat. In response to closure of the switch 10, the motor 20 is immediately energized causing an associated blower (not shown) to dissipate residual fuel vapor in the region occupied by the burner being controlled. However, activation of the burner control system 17 to both open the fuel supply valve 19 and initiate an ignition cycle is prevented at this time by the normally open contacts 14, 16. During half cycles in which terminal 12 is negative, the capacitor C1 will charge with the polarity indicated. On positive half cycles, the voltage across the capacitor C1 adds to the line potential between the terminals 12 and 13 so as to ultimately cause the capacitor C2 to charge with the polarity indicated to twice the peak line voltage. However, the capacitor C2 is large compared to the capacitor C1 so as to attain a full charge only after a predetermined delay period. For example, in a preferred embodiment, the ratio of the capacitor C2 to the capacitor C1 is 4,000 to 1 so that the capacitor C2 can be considered to have a charging time constant of about 67 seconds. However, after about 40 seconds when the charge on the capacitor C2 has reached a level of, for example, 130 volts, the threshold neon NE1 breaks over discharging the storage capacitor C2 into the winding of the relay K1 and thereby supplying thereto a given current magnitude required to energize the relay into an active state wherein the contacts 14, 16 close. Subsequently, the relay K1 is retained in that active state by the lesser current level supplied thereto through the resistor R3, but which reduced level was not sufficient to previously activate the relay. Closure of the contacts 14, 16 energizes the burner control system 17 which then opens the fuel valve 19 to initiate fuel flow and activates an ignition system to induce ignition thereof.

Thus, the storage capacitor C2 functions both as a timer to delay activation of the relay K1 and also as an energy accumulator that provides a transient input current level necessary to produce energization thereof. During this predetermined time delay period required for activation of the relay K1, the burner control system 17 remains inactive and the motor 20 generates air flow that purges residual fuel vapor from the burner. Furthermore, an examination of the system will show that a failure of any component in the circuit 11 will result in either passing of the desired purge delay time period prior to activation of the relay K1 or the inherently safe condition wherein no relay activation occurs.

It will be noted further that the opening of contacts 14, 15 by energization of the relay K1 disconnects the diode CR1. This prevents the flow of charging current to the capacitor C2 which is bled of any residual charge by the resistor R2. This substantially instantaneous reset of the timer circuit 11 in response to completion of a timing cycle insures that the predetermined purge period again will be provided prior to a subsequent try for ignition regardless of the time that has transpired after deactivation of the burner control system 17.

Obviously, many modifications and variations of the present invention are possible in light of the above teachings. It is therefore to be understood that within the scope of the appended claims the invention can be practised otherwise than as specifically described.

What is claimed is:

1. An electrical control system comprising:

a current responsive control means having an active and an inactive state, said control means requiring a given input current level to switch from said inactive to said active state and a substantially lesser input current level to maintain said active state;

a.c. electrical supply means;

hold circuit means for supplying said lesser input current level to said control means after connection to said supply means;

activating circuit means including a voltage doubler circuit means for supplying said given input current level to said control means after connection to said a.c. supply means, said voltage doubler means comprising timer means for delaying the application of said given input current level to said control means for a predetermined period after connection of said a.c. supply means; and process initiator means for initiating a given process in response to a change of said control means to said active state.

2. A system according to claim 1 wherein said voltage divider circuit means comprises a storage means for storing electrical energy from said supply means during said predetermined period, and said activating circuit means comprises trigger means for discharging the stored energy into said control means at the end of said predetermined period.

3. A system according to claim 2 wherein said activating circuit means comprises reset means for removing energy from said storage means and for preventing accumulation of energy thereby with said control means in said active state.

4. A system according to claim 3 wherein said storage means comprises capacitor means, said trigger means comprises voltage threshold means, and said control means comprises a relay having normally open contacts connected to fuel supply means and normally closed contacts connected to said activating circuit means.

5. A system according to claim 4 wherein said voltage divider circuit means comprises a first capacitor and a first diode connected in series across said a.c. supply means, a second capacitor and a second diode connected in series across said first diode, and said capacitor storage means is said second capacitor.

6. A system according to claim 5 wherein said process initiator means comprises fuel supply means for initiating fuel flow to a fuel burner.

7. A system according to claim 6 including igniter means for igniting fuel at the burner, said igniter means being energized in response to a change of said control means to said active state.

8. A system according to claim 7 including blower means for dissipating fuel at the burner and energized in response to connection of said supply means to said activating circuit means.

9. A system according to claim 1 wherein said voltage divider circuit means comprises a first capacitor and a first diode connected in series across said a.c. supply means, and a second capacitor and a second diode connected in series across said first diode.

10. A system according to claim 9 wherein said second capacitor is substantially larger than said first capacitor.

11. A system according to claim 9 wherein said process initiator means comprises fuel supply means for initiating fuel flow to a fuel burner.

12. A system according to claim 11 including igniter means for igniting fuel at the burner, said igniter means being energized in response to a change of said control means to said active state.

13. A system according to claim 11 including blower means for dissipating fuel at the burner and energized in response to connection of said supply means to said activating circuit means.

* * * * *